US009321573B2

(12) United States Patent
Rozanski

(10) Patent No.: US 9,321,573 B2
(45) Date of Patent: Apr. 26, 2016

(54) DISPLAY PACKAGE

(71) Applicant: Master Lock Company LLC, Oak Creek, WI (US)

(72) Inventor: Alan L. Rozanski, Franklin, WI (US)

(73) Assignee: MASTER LOCK COMPANY LLC, Oak Creek, WI (US)

( * ) Notice: Subject to any disclaimer, the term of this patent is extended or adjusted under 35 U.S.C. 154(b) by 0 days.

(21) Appl. No.: 14/613,592

(22) Filed: Feb. 4, 2015

(65) Prior Publication Data

US 2015/0217918 A1 Aug. 6, 2015

Related U.S. Application Data

(60) Provisional application No. 61/935,916, filed on Feb. 5, 2014.

(51) Int. Cl.

| | |
|---|---|
| ***B65D 73/00*** | (2006.01) |
| ***E05B 67/00*** | (2006.01) |
| ***E05B 17/00*** | (2006.01) |
| ***B65D 85/00*** | (2006.01) |

(52) U.S. Cl.

CPC ..... *B65D 73/0014* (2013.01); *B65D 85/70* (2013.01); *E05B 17/00* (2013.01); *E05B 67/00* (2013.01); *Y10T 70/446* (2015.04)

(58) Field of Classification Search

USPC ..... 206/349, 469, 470, 471, 495, 806, 1.5

See application file for complete search history.

(56) References Cited

U.S. PATENT DOCUMENTS

| | | | |
|---|---|---|---|
| 791,912 | A | 6/1905 | Jackson |
| 997,154 | A | 7/1911 | Slaymaker et al. |
| 2,949,185 | A | 8/1960 | Foote et al. |
| 3,236,372 | A | 2/1966 | Foote |
| 3,251,465 | A | 5/1966 | Winkhaus et al. |
| 3,289,830 | A | 12/1966 | Foote |
| 3,497,059 | A | 2/1970 | Watts, Jr. |
| 3,586,163 | A | 6/1971 | Loehrer et al. |
| 4,020,694 | A | 5/1977 | Mayhew |
| 4,328,894 | A | 5/1982 | Edell |
| 4,512,466 | A | 4/1985 | Delang |
| 4,613,038 | A | 9/1986 | Kirk |
| 4,711,352 | A | 12/1987 | Williams et al. |
| 4,948,036 | A | 8/1990 | Loughman |

(Continued)

OTHER PUBLICATIONS

International Search Report and Written Opinion from International Application No. PCT/US2006/46728, mailed Jul. 11, 2008.

(Continued)

*Primary Examiner* — Jacob K Ackun

(74) *Attorney, Agent, or Firm* — Calfee, Halter & Griswold LLP

(57) ABSTRACT

A padlock, a key for unlocking the padlock, and a padlock display package are provided in combination. The padlock includes a shackle lockable with a lock body. The padlock display package includes a base member having a front side and a back side, a shackle retaining member extending from the front side of the base member, and a key retainer secured to the base member. The locked shackle of the padlock is positioned around at least a portion of the shackle retaining member to secure the padlock to the display package. The key retainer includes a cavity receiving at least a portion of the key therein, and the padlock prevents removal of the key from the key retainer.

18 Claims, 13 Drawing Sheets

(56) References Cited

U.S. PATENT DOCUMENTS

| | | | |
|---|---|---|---|
| 5,259,169 | A | 11/1993 | Appelbaum |
| 5,713,467 | A | 2/1998 | Kao |
| 5,730,296 | A | 3/1998 | Limmer |
| 6,164,463 | A | 12/2000 | Lee |
| 6,241,092 | B1 | 6/2001 | Vasudeva |
| 6,257,536 | B1 | 7/2001 | Manuel |
| 6,378,700 | B1 | 4/2002 | Tong |
| 6,401,924 | B1 | 6/2002 | Fresnel |
| 6,520,324 | B1 | 2/2003 | Matthews et al. |
| 6,679,379 | B1 | 1/2004 | Kao |
| 6,749,060 | B2 | 6/2004 | Ford |
| D494,066 | S | 8/2004 | Liu |
| 6,935,516 | B2 | 8/2005 | Chiang |
| D540,160 | S | 4/2007 | Konop et al. |
| D571,207 | S | 6/2008 | Rozanski |
| D571,208 | S | 6/2008 | Rozanski |
| D571,209 | S | 6/2008 | Rozanski |
| D571,210 | S | 6/2008 | Rozanski |
| D571,211 | S | 6/2008 | Rozanski |
| D571,212 | S | 6/2008 | Rozanski |
| D571,658 | S | 6/2008 | Rozanski |
| D571,659 | S | 6/2008 | Rozanski |
| D571,660 | S | 6/2008 | Rozanski |
| D572,132 | S | 7/2008 | Rozanski |
| 7,516,843 | B2 | 4/2009 | Konop et al. |
| 7,708,140 | B2 | 5/2010 | Konop et al. |
| 7,743,917 | B2 | 6/2010 | Konop et al. |
| 7,905,351 | B2 | 3/2011 | Konop et al. |
| 2003/0024831 | A1 | 2/2003 | Matthews et al. |
| 2003/0034316 | A1 | 2/2003 | Kao |
| 2005/0035013 | A1 | 2/2005 | Bates et al. |
| 2011/0226653 | A1* | 9/2011 | Zorc ..... 206/481 |
| 2011/0226654 | A1* | 9/2011 | Zorc ..... 206/488 |

OTHER PUBLICATIONS

Brinks, Model No. 105-626011, 6 foot Water Resistant 5/8" Key Locking Steel Cable, date unknown, known prior art.

Brinks, Model No. 105-38901, 9 foot Weather Resistant 3/8" Steel Cable, date unknown, known prior art.

Kryptonite, 6'×5/8" Locking Cable, date unknown, known prior art.

Kryptonite, 30'×3/8" Braided Steel Cable, date unknown, known prior art.

Master Lock, Model No. 72DPF, 15'×3/8" Heavy Duty Braided Steel Cable, at least as early as Dec. 31, 2002, 2 pages.

Master Lock, Model No. 78DPF, 6'×3/8" Braided Steel Cable, at least as early as Dec. 31, 2002, 2 pages.

Master Lock Model No. 8119DPF, 5' Resettable Combination Cable Lock, at least as early as Dec. 31, 2001, 2 pages.

Master Lock, Model No. 8113DPF, 5' Keyed Cable Lock, at least as early as Dec. 31, 2001, 2 pages.

Master Lock, Model No. 8154DPF, 6' Keyed Cable Lock, at least as early as Dec. 31, 2001, 2 pages.

Master Lock, Model No. 8143DSG, Bike Series, 4ft. Combination Cable Lock, at least as early as Dec. 31, 2011, 2 pages.

* cited by examiner

DISPLAY PACKAGE

CROSS-REFERENCE TO RELATED APPLICATION

This application claims priority to and the benefit of U.S. Provisional Patent Application Ser. No. 61/935,916, entitled "DISPLAY PACKAGE" and filed Feb. 5, 2014, the entire disclosure of which is incorporated herein by reference.

BACKGROUND

Products are packaged for a variety of retail and commercial purposes, such as for example, for storage, transportation, and display. One type of package known in the art is display card and blister packaging. This type of packaging is used for many products, including, for example, padlocks, such as key operated padlocks and combination padlocks. Conventional packaging typically encapsulates or surrounds the entire product and is sealed closed to prevent removal of the product, for example, to inhibit or deter theft of the product from a retail location. However, this type of packaging, designed to prevent removal of the product from the packaging at the store, may also make it difficult or time consuming for a consumer to remove the product from the packaging after purchase. Also, with most or all of the product encapsulated by this conventional packaging, pre-purchase inspection of the product by a consumer may be inhibited, as a potential buyer may be unable to see or feel many or most of the surfaces of the product.

SUMMARY

The present application describes display packages for items having a loop portion (e.g., a padlock with a shackle) secured to the display package, with the display package securely retaining an accessory (e.g., a padlock key) while the item is secured to the display package.

Accordingly, in an exemplary embodiment, a padlock, a key for unlocking the padlock, and a padlock display package are provided in combination. The padlock includes a shackle lockable with a lock body. The padlock display package includes a base member having a front side and a back side, a shackle retaining member extending from the front side of the base member, and a key retainer secured to the base member. The locked shackle of the padlock is positioned around at least a portion of the shackle retaining member to secure the padlock to the display package. The key retainer includes a cavity receiving at least a portion of the key therein, and the padlock prevents removal of the key from the key retainer.

According to another exemplary embodiment, a method is provided for displaying a padlock having a shackle releasable from a lock body by a key. In the exemplary method, a display package is provided having a base member with a shackle retaining member extending from a front side of the base member. At least a portion of the key is retained in a cavity of a key retainer disposed on the base member. The locked shackle of the padlock is positioned around at least a portion of the shackle retaining member such that the padlock is secured to the display package, with the padlock preventing removal of the key from the key retainer.

BRIEF DESCRIPTION OF THE DRAWINGS

Further features and advantages of the invention will become apparent from the following detailed description made with reference to the accompanying drawings, wherein.

DETAILED DESCRIPTION

Figure 1:
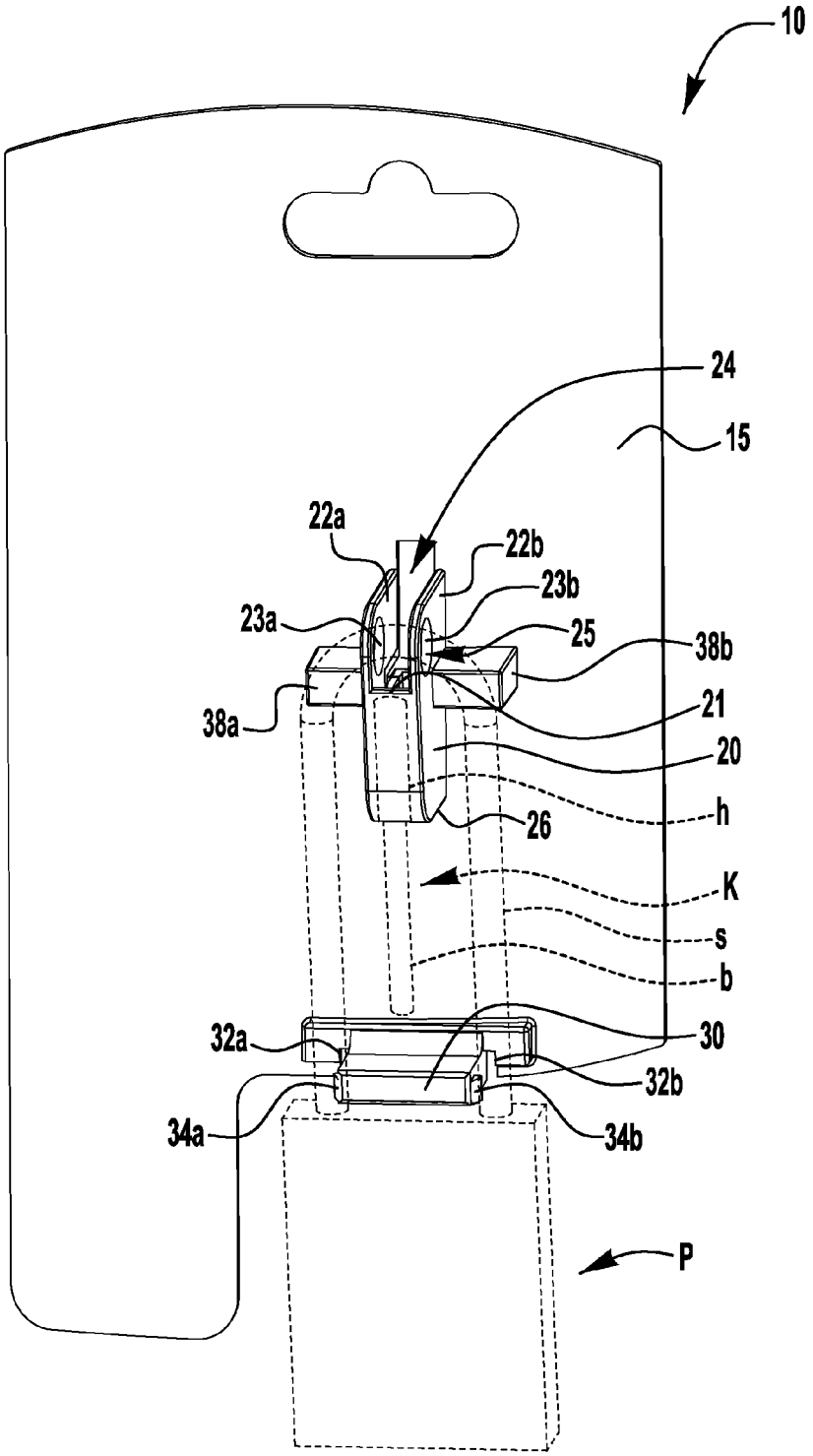
FIG. 1 is a front view of a display package, showing a padlock and key retained on the display package in broken likes, according to an exemplary embodiment.

This Detailed Description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein are mechanical key operated padlocks, the features of the present application may additionally or alternatively be applied to other types of padlocks, including, for example, single or multiple dial combination padlocks and electronically operated padlocks, such as remote operated padlocks (e.g., by an RFID, infrared, audible, or vibratory signal transmitter), or display packages used with other items having loop portions, including, for example, cable locks, wrist watches and carabiners.

As described in the present application, a display package may be configured to securely retain one or more items for display while increasing the areas of the item that may be touched or grasped by a user, such as a potential purchaser, and/or reducing the amount of packaging materials that must be cut, torn, or otherwise separated in order to access the packaged item. In one such embodiment, a display package for an item may include a retaining member for engaging or receiving a loop portion of the item, such as a strap, band, cable, link, or shackle, to secure the item to the package. For example, a retaining member of a display package may include a hasp extending from a front side of a base member (e.g., a card or substrate) of the package defining a slot for receiving a loop portion through the slot, to secure the item to the package. In an exemplary embodiment, a padlock display package includes a card having a front side and a back side and a hasp extending from the front side of the card to define a slot. The padlock is attachable to the display package by inserting the padlock's shackle through the slot and locking the shackle with the lock body. Exemplary padlock display packages including a padlock retaining hasp are described in U.S. Pat. Nos. 7,516,843; 7,708,140; 7,743,917; and 7,905,351, the entire disclosures of each of which are incorporated herein by reference.

When packaging a padlock or other such item, it may be desirable to retain one or more accessories with the packaging, such as, for example, one or more keys for unlocking the padlock. According to an exemplary aspect of the present application, a key may be secured with a padlock display package in such a way that access to, removal of, and/or use of the key is prevented or impeded while the locked padlock is secured with a retaining member (e.g., a hasp or post with which the padlock shackle is engaged) on the display package. In one exemplary embodiment, the key is receivable or at least partially retained within a cavity of a key retainer disposed on a base member or display card (e.g., integral to or assembled with a base member or card of the display package). In some exemplary embodiments, such an arrangement may eliminate the use of ties or other fasteners to secure the key to the display package, which may reduce packaging time and/or costs, and may reduce the risks of the key being separated from the package (e.g., due to damage to the packaging or fastener during packing or shipping).

Figure 2:
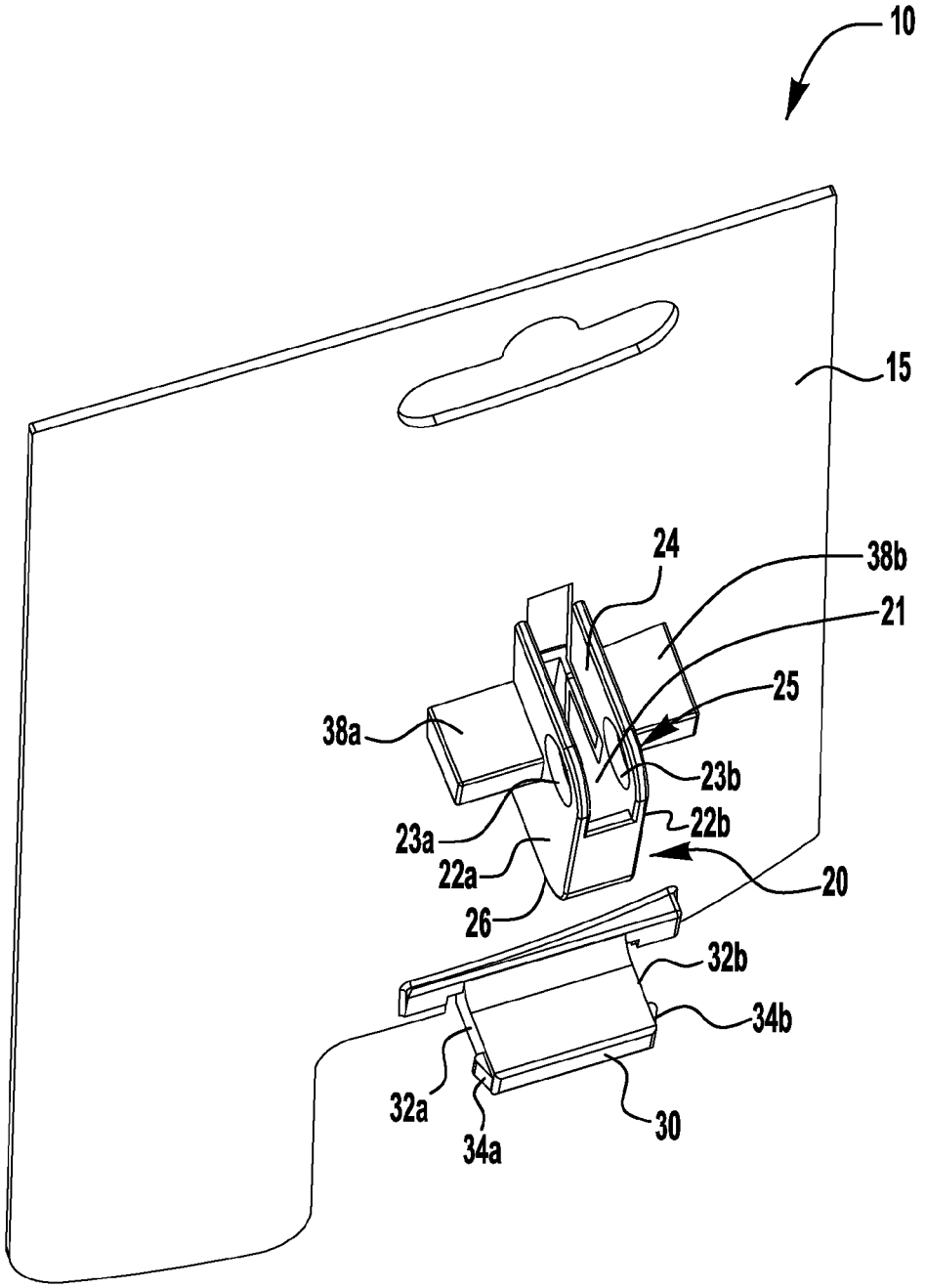
FIG. 2 is an upper perspective view of the display package of FIG. 1.
Figure 3:
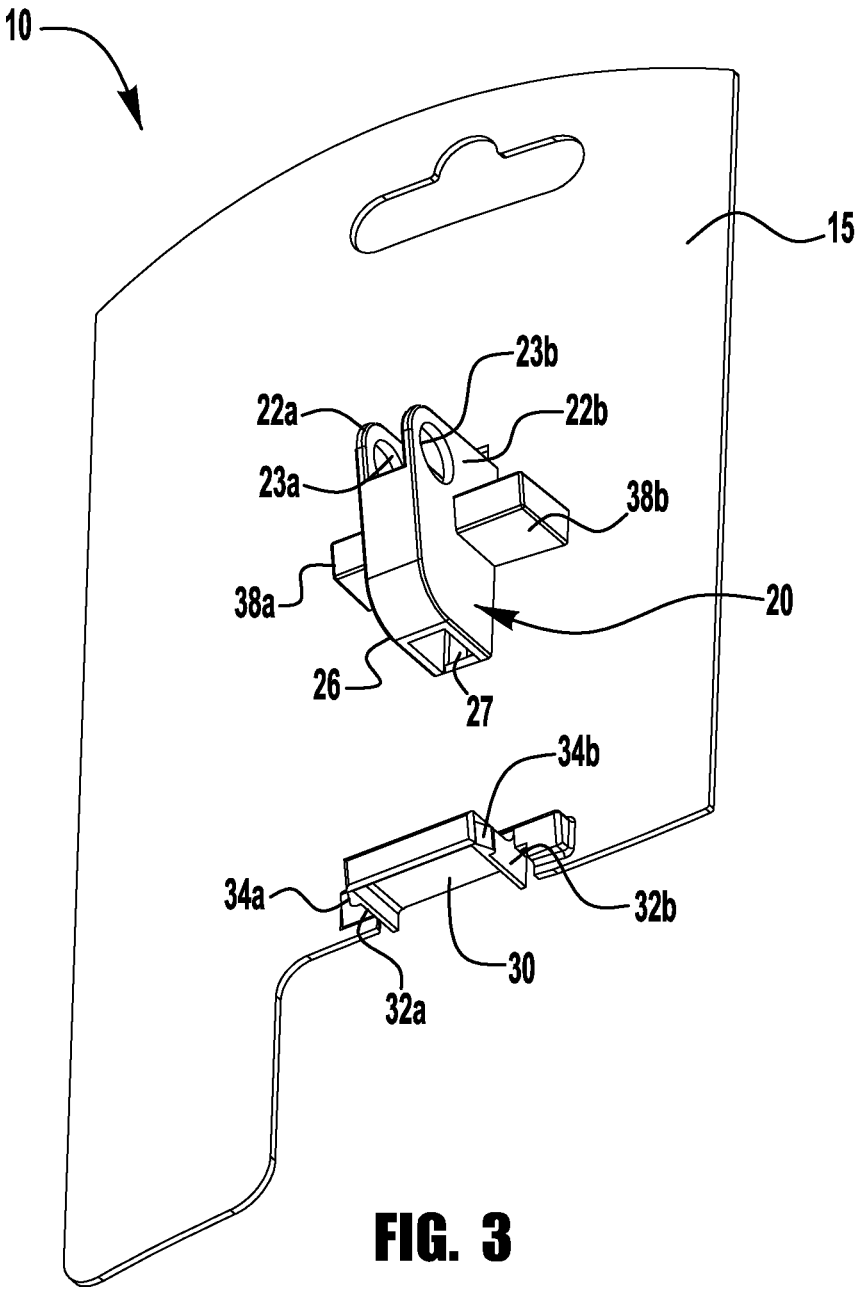
FIG. 3 is a lower perspective view of the display package of FIG. 1.

In one embodiment, a hasp portion of a display package, having a slot or passage through which a padlock shackle is secured to retain the padlock on the display package, further defines a key retainer including a cavity within which at least a portion of one or more keys (e.g., the key head) may be retained. When the key is received in the cavity of the key retainer, insertion of the padlock shackle through the hasp slot blocks withdrawal of the key from the cavity. While a padlock retaining hasp may include many different structures for defining a key retainer, in an exemplary embodiment, as shown in FIGS. 1-3, a display package 10 is provided with a hasp 20 extending from a front side of a base member or card 15. The hasp 20 includes side walls 22*a*, 22*b* having apertures 23*a*, 23*b* defining a shackle passage 25. The side walls 22*a*, 22*b* are spaced apart to define a cavity 21 and extend to an open upper end 24 of the hasp 20 to receive one or more keys K therebetween. A bottom wall 26 of the key retainer portion retains at least the key head h within the cavity 21. As shown in FIG. 3, the bottom wall 26 may be provided with a slot 27 sized to receive the key blade b therethrough while retaining the key head h in the cavity 21. As shown in FIG. 1, when a shackle s of a padlock P is installed through the shackle passage 25, the shackle s blocks withdrawal of the key K from the key cavity 21 through the upper end 24 of the hasp 20. To access the key K and unlock the lock (e.g., post-purchase), a user may cut a portion of the base member 15 or hasp 20 to extract the key K, for example, using a knife, scissors, or other such household tool. The portion to be cut may be thinner or perforated to facilitate cutting.

In some embodiments, the padlock display package may be provided with additional padlock retaining features. For example, the display package may include one or more padlock retaining features that limit side-to-side or outward swinging movement of the padlock on the display package, for example, by engaging side or front portions of the shackle or lock body. In one such embodiment, as shown in FIGS. 1-3, the base member 15 includes a padlock retaining projection 30 that is received between the legs of the shackle s when the padlock P is assembled with the display package 10. The projection 30 includes side portions 32*a*, 32*b* that engage inner surfaces of the shackle legs to limit side-to-side swinging movement of the padlock P, and laterally outward extending barbs or hooks 34*a*, 34*b* that engage front facing surfaces of the shackle legs to limit outward swinging movement of the padlock P. The hooks 34*a*, 34*b* may be flexible enough to allow a padlock shackle to be pushed past the hooks to snap into a shackle retaining condition. As shown, the display package 10 may also include padlock positioning projections 38*a*, 38*b* extending from the sides of the hasp 20 and engaging rear surfaces of the shackles to position the padlock on the card 15.

Figure 4:
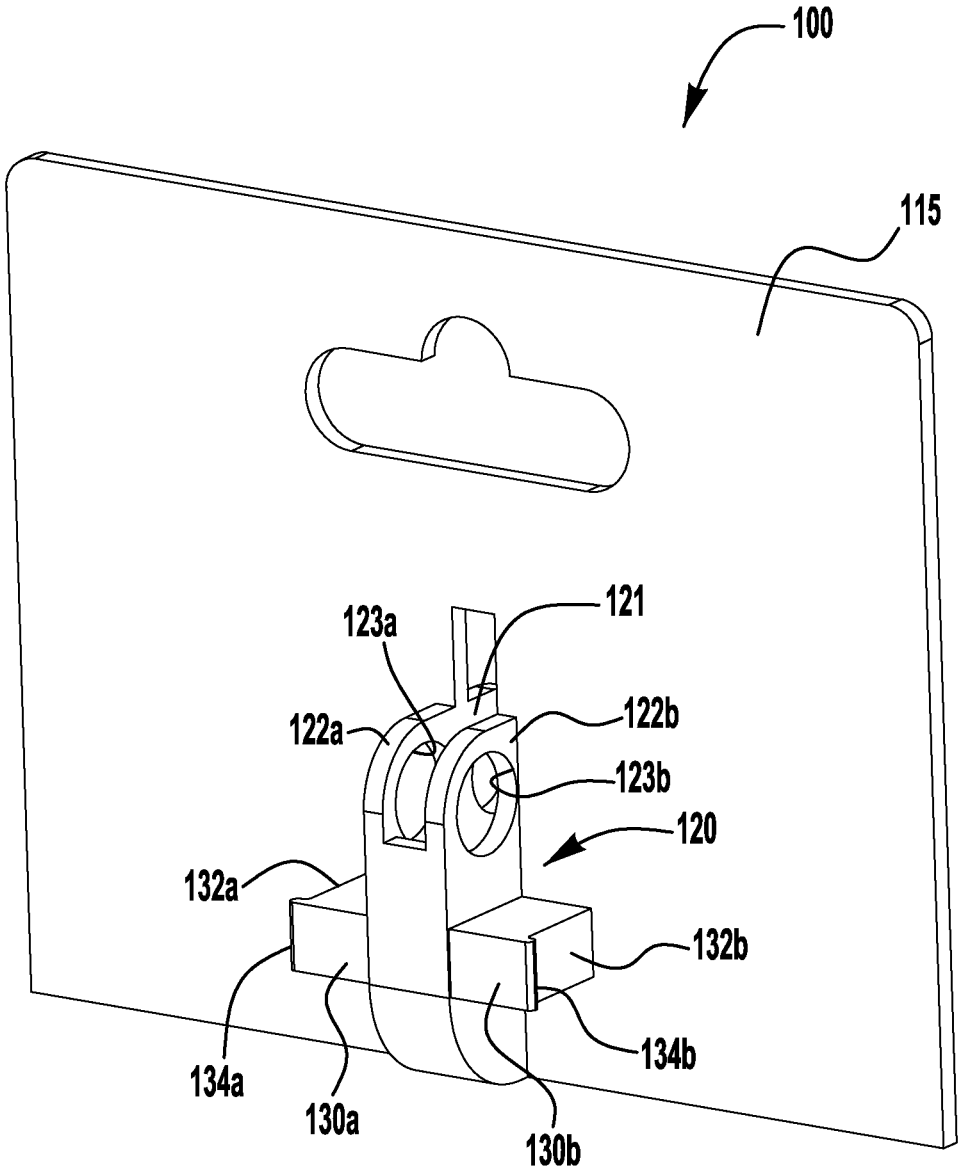
FIG. 4 is a front perspective view of a display package, according to another exemplary embodiment.

In other embodiments, padlock retaining projections may be aligned with the hasp portion, for example, to accommodate a shorter shackle. FIGS. 4A and 4B illustrate an exemplary display package 100 provided with a base member or card 115 and a key cavity defining hasp 120, which may, but need not, be similar to the hasp 20 of the embodiment of FIGS. 1-3. Padlock retaining projections 130*a*, 130*b* extend from the side walls 122*a*, 122*b* and include side portions 132*a*, 132*b* that engage inner surfaces of the shackle legs to limit side-to-side swinging movement of the padlock, and laterally outward extending barbs or hooks 134*a*, 134*b* that engage front facing surfaces of the shackle legs to limit outward swinging movement of the padlock. The hooks 134*a*, 134*b* may be flexible enough to allow a padlock shackle to be pushed past the hooks to snap into a shackle retaining condition.

Figure 5:
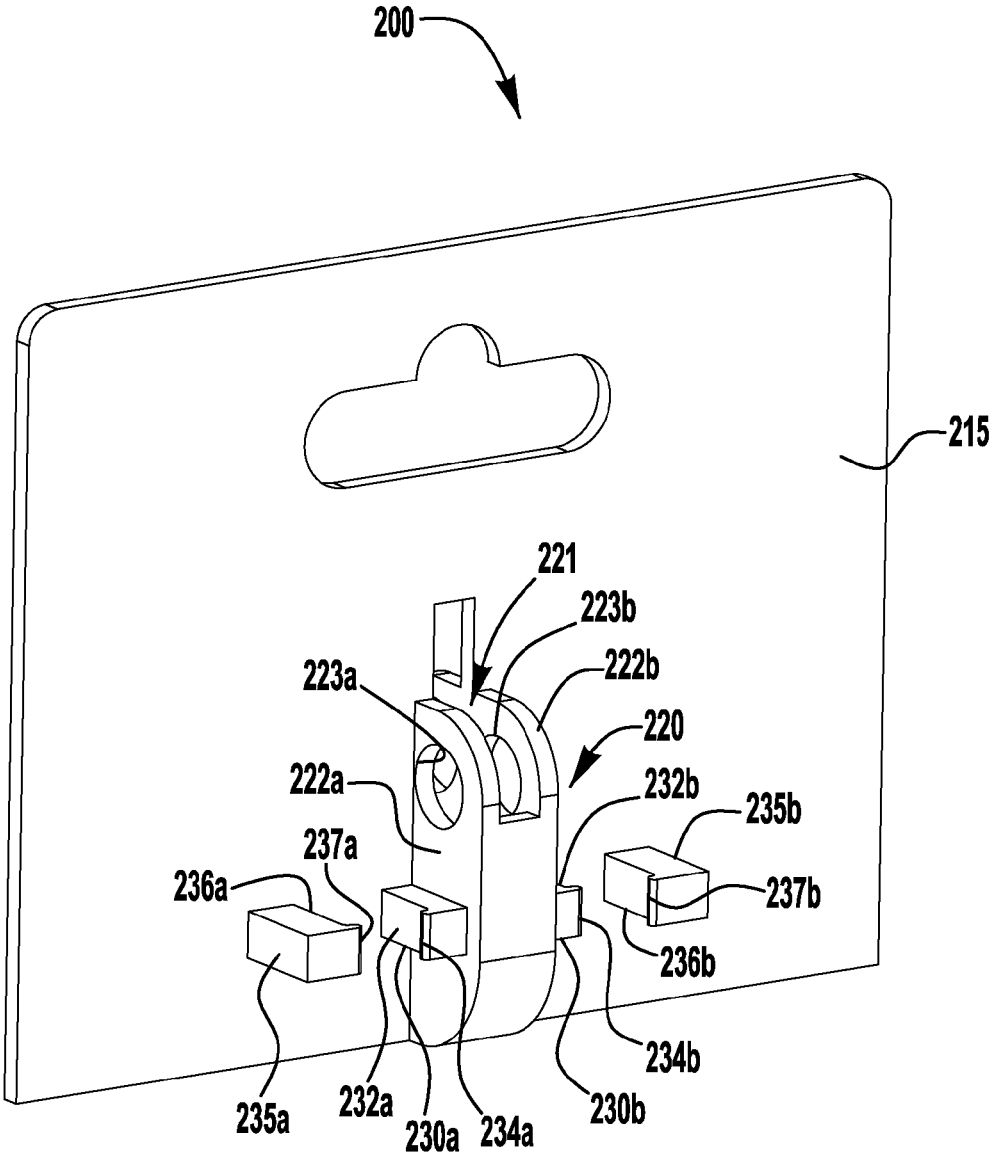
FIG. 5 is a front perspective view of a display package, according to still another exemplary embodiment.

As another example, a display package may additionally or alternatively be provided with outer padlock retaining projections that engage outer surfaces of the shackle legs to limit side-to-side swinging movement of the padlock. FIG. 5 illustrates an exemplary display package 200 provided with a base member or card 215 and a key cavity defining hasp 220, which may, but need not, be similar to the hasp 20 of the embodiment of FIGS. 1-3. Inner padlock retaining projections 230*a*, 230*b* extend from the side walls 222*a*, 222*b* and include side portions 232*a*, 232*b* that engage inner surfaces of the shackle legs to limit side-to-side swinging movement of the padlock P, and laterally outward extending barbs or hooks 234*a*, 234*b* that engage front facing surfaces of the shackle legs to limit outward swinging movement of the padlock. The hooks 234*a*, 234*b* may be flexible enough to allow a padlock shackle to be pushed past the hooks to snap into a shackle retaining condition. Outer padlock retaining projections 235*a*, 235*b* extend from the front side of the base member 215, spaced apart from the first padlock retaining projections 230*a*, 230*b* to receive the shackle legs between the pairs of retaining projections. The outer padlock retaining projections include side portions 236*a*, 236*b* that engage outer surfaces of the shackle legs to limit side-to-side swinging movement of the padlock P, and laterally inward extending barbs or hooks 237*a*, 237*b* that engage front facing surfaces of the shackle legs to limit outward swinging movement of the padlock. The hooks 237*a*, 237*b* may be flexible enough to allow a padlock shackle to be pushed past the hooks to snap into a shackle retaining condition. In another embodiment (not shown), a display package may be provided with only outer padlock retaining projections and without inner padlock retaining projections.

Figure 6:
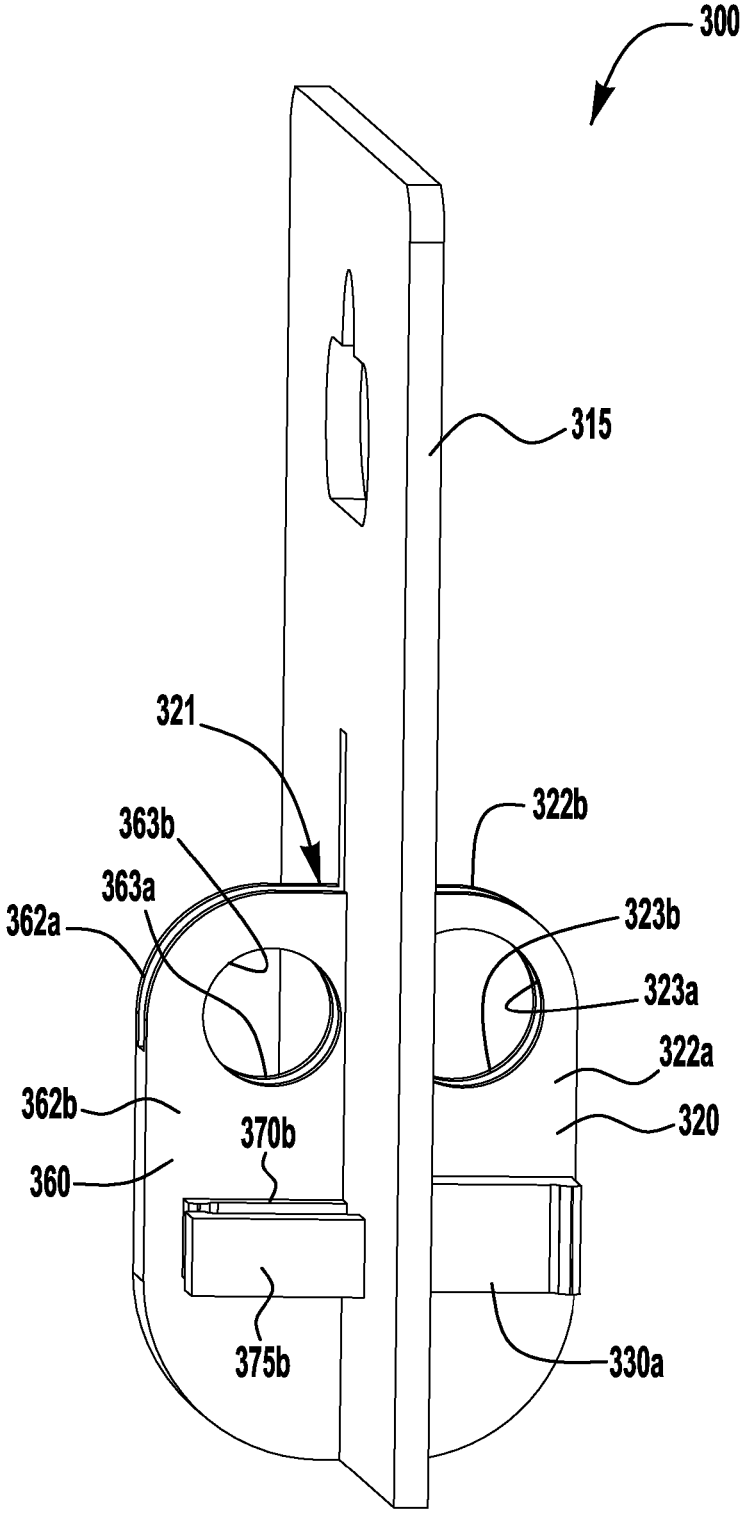
FIG. 6 is a side perspective view of a dual sided display package, according to an exemplary embodiment.
Figure 7:
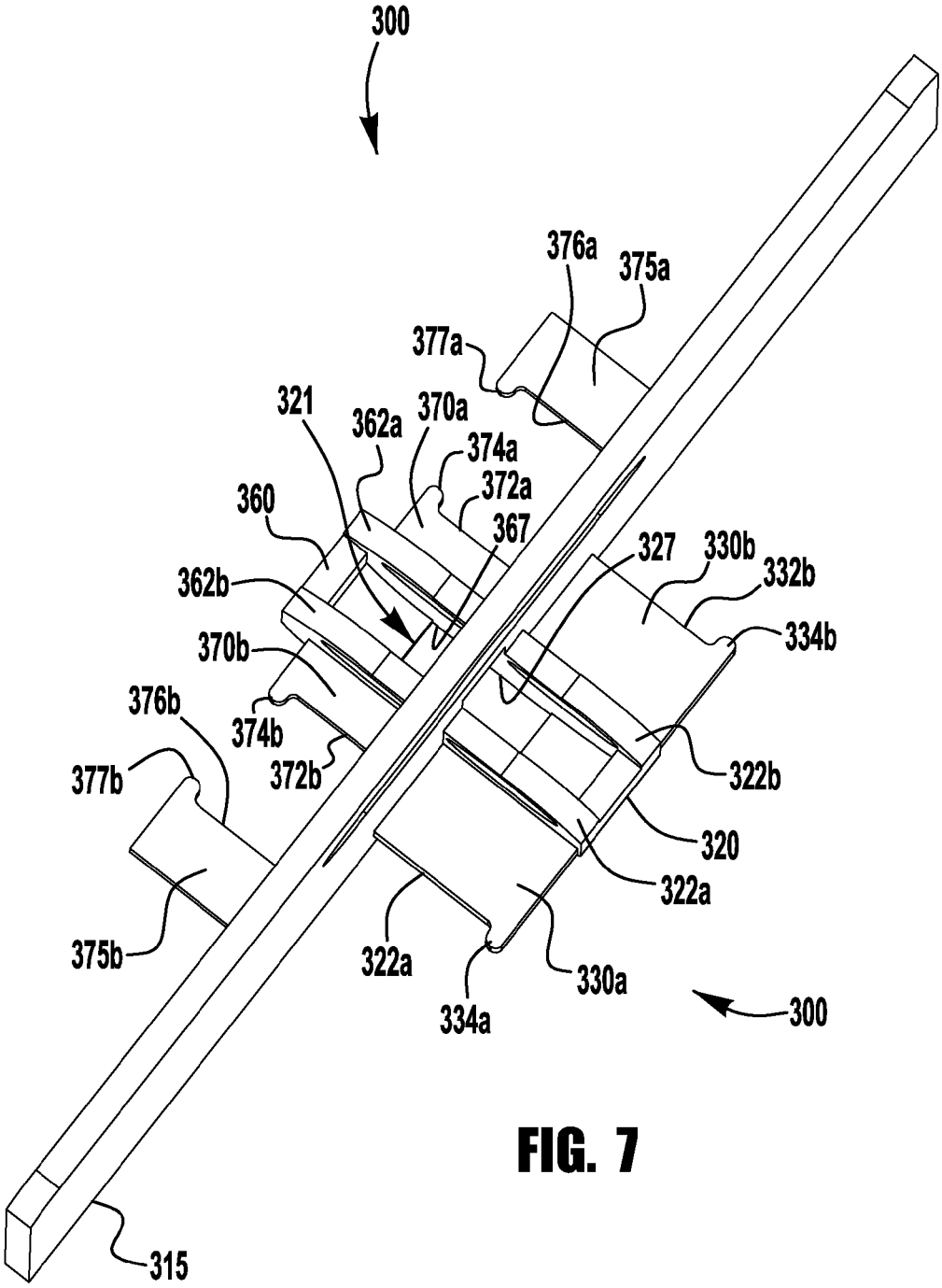
FIG. 7 is a top view of the display package of FIG. 6.

Different display packages may be provided for use with different sized padlocks, for example, with different sized or dimensioned hasps and padlock retaining features. In one embodiment, a padlock display package may be provided with a first hasp and first set of padlock retaining features disposed on a first side of a base member and sized for retaining a first padlock, and a second hasp and second set of padlock retaining features disposed on a second side of the base member and sized for retaining a second padlock. FIGS. 6 and 7 illustrates an exemplary display package 300 including a first hasp 320 and first set of padlock retaining projections 330*a*, 330*b* extending from a first side of a base member or card 315. The first hasp 320 and first set of padlock retaining projections 330*a*, 330*b* may, but need not, be consistent with the hasp 120 and padlock retaining projections 130*a*, 130*b* of the display package 100 of FIG. 4. The display package further includes a second hasp 360 and second set of padlock retaining projections 370*a*, 370*b*, 375*a*, 375*b* extending from the second side of the base member 315. The second hasp 360 and second set of padlock retaining projections 370*a*, 370*b*, 375*a*, 375*b* may, but need not, be consistent with the hasp 220 and padlock retaining projections 230*a*, 230*b*, 235*a*, 235*b* of the display package 200 of FIG. 5. As shown, the first and second hasps 320, 360 may together define a single key retainer cavity 321, with the key blade being extendable through either slot 327, 367.

Figure 8:
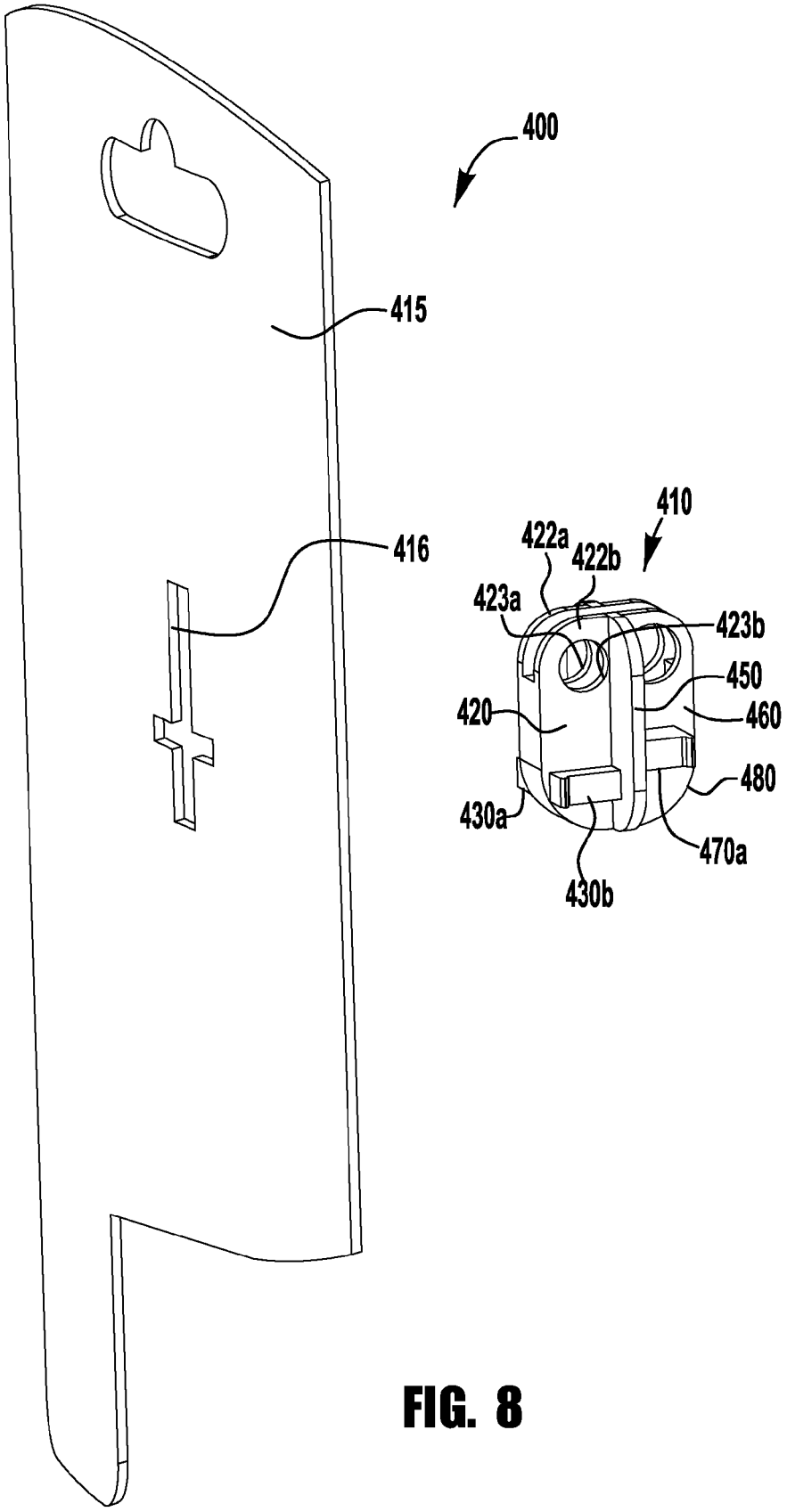
FIG. 8 is an exploded perspective view of a two-piece display package, according to an exemplary embodiment.
Figure 9:
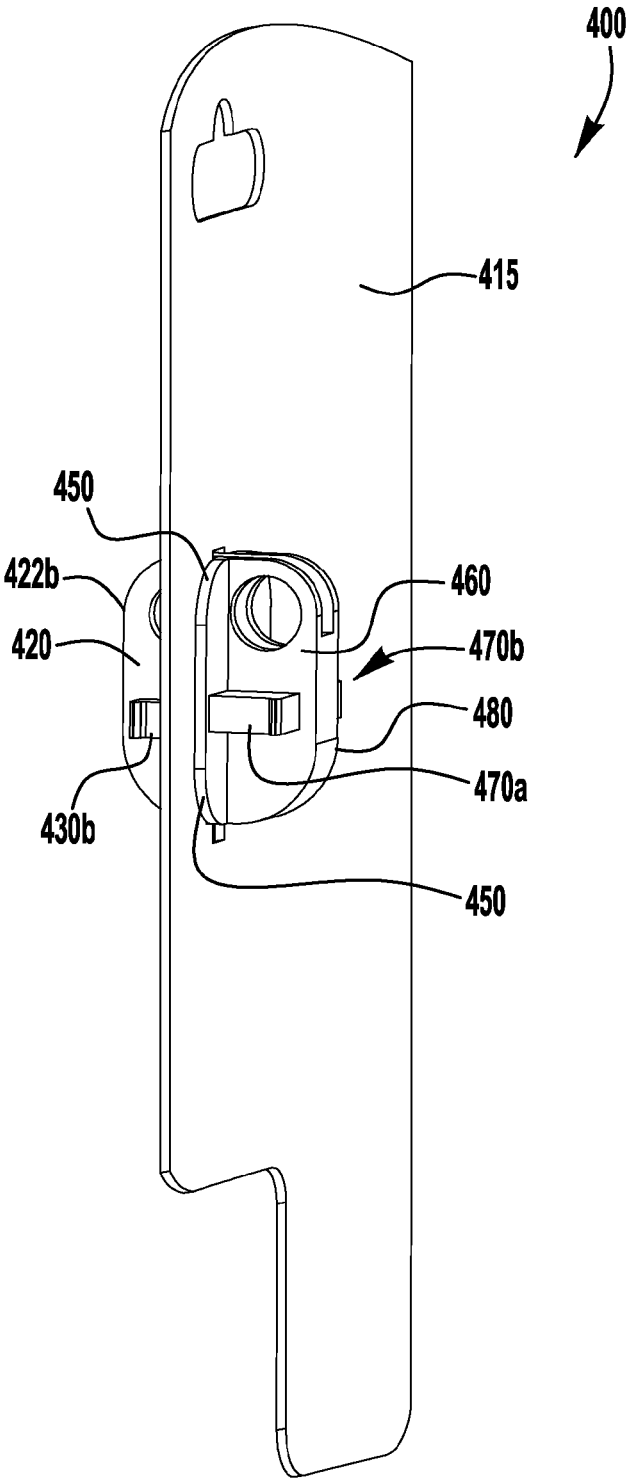
FIG. 9 is a rear side perspective view of the display package of FIG. 8.

Also, while the display package may be provided as an integral one-piece component (e.g., an injection-molded component), in another embodiment, the shackle retaining member and key retainer may be provided as a separate component for assembly with a base member (for example, to provide a plastic hasp and key retainer on a cardboard display card). FIGS. 8 and 9 illustrate an exemplary display package 400 including an insert 410 assembled through an opening 416 in a base member or card 415. The exemplary insert 410 includes a hasp 420 and inner padlock retaining projections 430*a*, 430*b* (which may, but need not be similar to the hasp 120 and padlock retaining features 132*a*, 132*b* of the display package 100 of FIG. 4), and an outer flange 450 that engages a rear side of the base member 415, such that the hasp 420 and inner padlock retaining projections 430*a*, 430*b* extend from the front side of the base member 415. When a padlock is assembled with the display package 400, the shackle prevents disassembly of the insert 410 from the base member 415. As shown, side walls 422*a*, 422*b* of the hasp 420 may extend beyond the rear side of the base member 415, for example, to accommodate a larger key head. As shown, a rear portion 480 of the insert 410 may be provided with a second hasp 460 and second set of padlock retaining projections 470*a*, 470*b*, for example, to accommodate a different sized padlock by inserting the rear portion 480 of the insert 410 through the card opening 416.

Figure 10A:
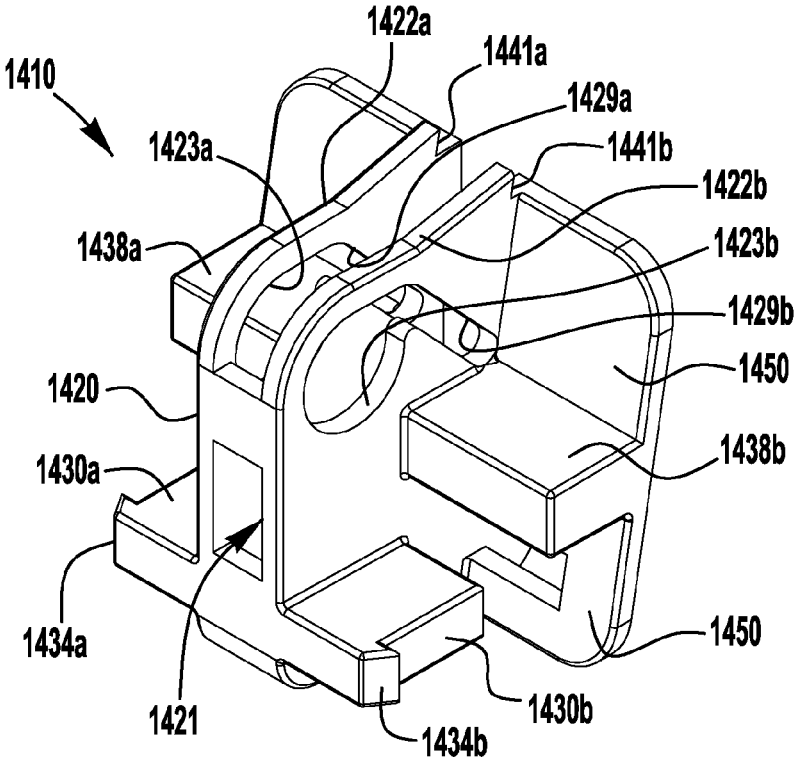
FIG. 10A is a front perspective view of a packaging insert, according to an exemplary embodiment.
Figure 10B:
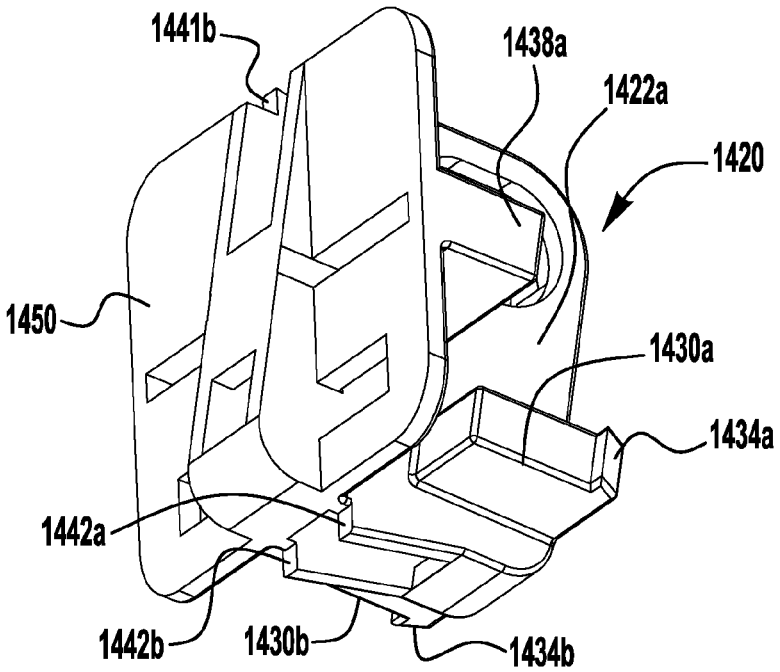
FIG. 10B is a rear perspective view of the packaging insert of FIG. 10A.
Figure 11:
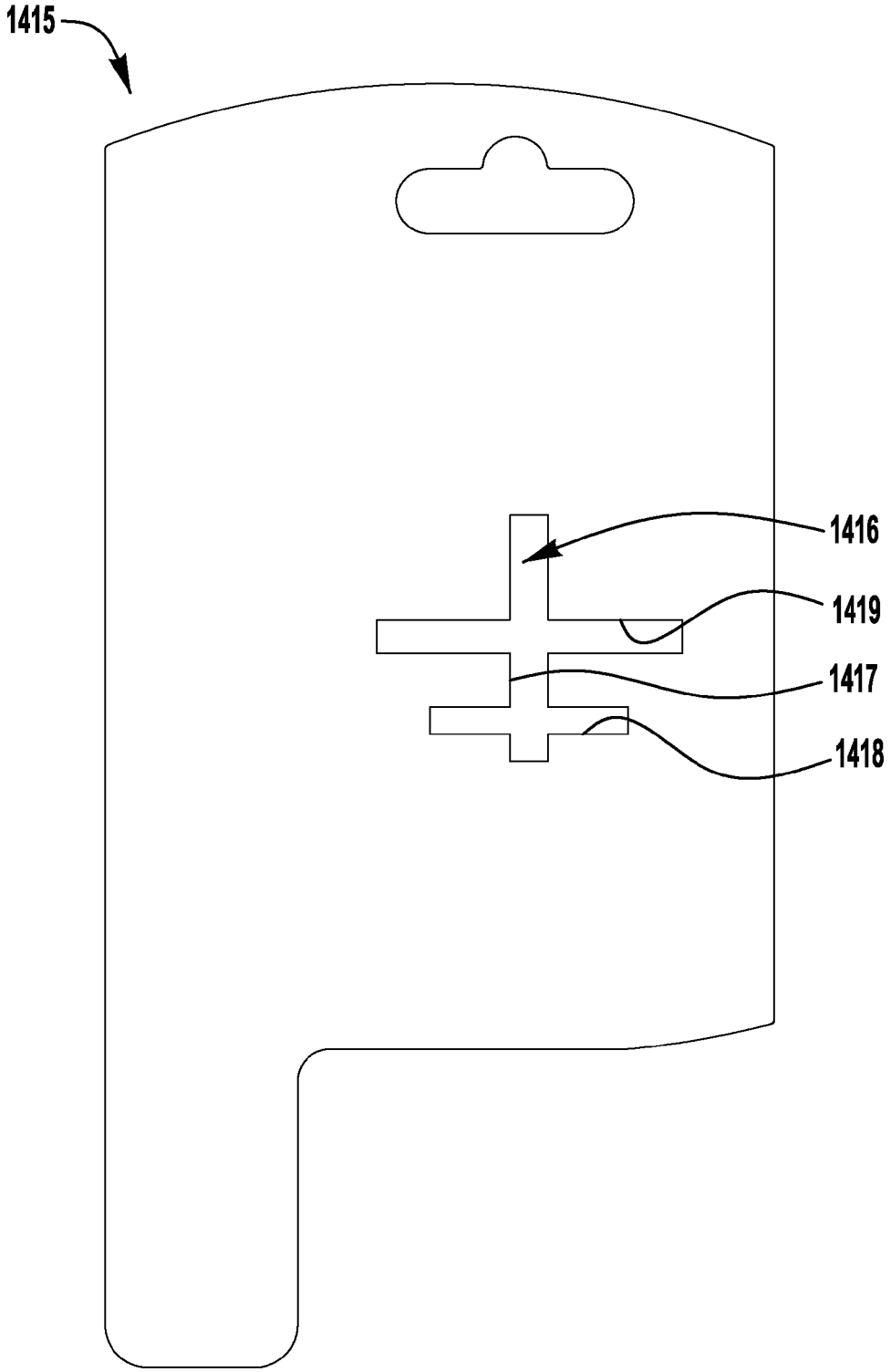
FIG. 11 is a front view of a display card for use with the packaging insert of FIG. 10A.

In still other embodiments, a padlock packaging insert may additionally include integral padlock positioning projections extending from the sides of the hasp and engaging rear surfaces of the shackle to position the padlock on the card. FIGS. 10A and 10B illustrate an exemplary padlock packaging insert 1410 for assembly with a base member or card 1415 (FIG. 11) as a padlock packaging arrangement. The insert 1410 is similar to the insert 410 of FIGS. 8 and 9, but with padlock positioning projections 1438*a*, 1438*b* extending laterally outward from the sides of a hasp 1420 for engaging rear surfaces of the shackle to position the padlock on the card. While the insert 1410 of FIGS. 10A and 10B is a single sided insert defining a single hasp, the insert may alternatively be configured as a double sided insert having two opposed hasp portions, like the insert 410 of FIGS. 8 and 9.

The exemplary insert 1410 of FIGS. 10A and 10B further includes inner padlock retaining projections 1430*a*, 1430*b* (with shackle retaining barbs or hooks 1434*a*, 1434*b*), a hasp 1420 including side walls 1422*a*, 1422*b* defining a key cavity 1421 therebetween, with apertures 1423*a*, 1423*b* defining a shackle receiving passage 1425, and an outer flange 1450 that engages a rear side of the card 1415. The card 1415 includes an opening 1416 with slotted portions 1417, 1418, 1419 shaped to accommodate the hasp 1420, inner padlock retaining projections 1430*a*, 1430*b*, and padlock positioning projections 1438*a*, 1438*b*, such that these features extend from a front side of the card 1415 when the outer flange 1450 abuts the rear side of the card 1415. The card may be provided in a flexible material, such as plastic, such that the card material around the opening 1416 may be flexed past ramped side walls 1422*a*, 1422*b* of the hasp 1420 and into interlocking engagement with notched rear edges 1441*a*, 1441*b*, 1442*a*, 1442*b* of the hasp walls 1422*a*, 1422*b*. When a padlock is assembled with the display package, the shackle prevents disassembly of the insert 1410 from the card 1415. As shown, the side walls 1422*a*, 1422*b* of the hasp 1420 may extend rearward of the flange 1450 and beyond the rear side of the card 1415, for example, to accommodate a larger key head. The hasp side walls 1442*a*, 1442*b* may include slotted portions 1429*a*, 1429*b* extending from the apertures 1423*a*, 1423*b* to accommodate scissors or some other cutting tool used to cut or clip the upper portions of the hasp side walls 1422*a*, 1422*b*, for removal of the locked padlock from the insert 1410.

To attach a padlock and key to one of the exemplary display packages of FIGS. 1-11, the key is deposited into the key cavity through the open upper end of the key retainer portion. The shackle of the unlocked padlock is then inserted through the hasp and the shackle is locked with the lock body. The shackle legs are snapped into engagement with the padlock retaining projections. To remove the padlock from the display package (e.g., post-purchase), the key is removed from the key retainer (e.g., by cutting a portion of the hasp or key card), and the key is used to unlock the padlock. The shackle is then withdrawn from the hasp.

Figure 12:
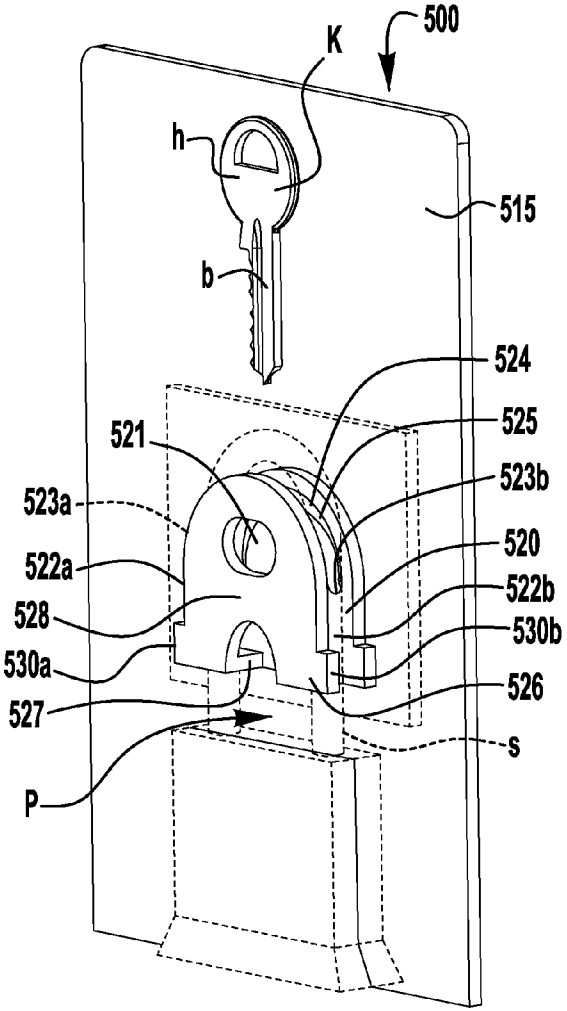
FIG. 12 is a front view of another display package, showing a padlock and key retained on the display package in broken likes, according to an exemplary embodiment.
Figure 14:
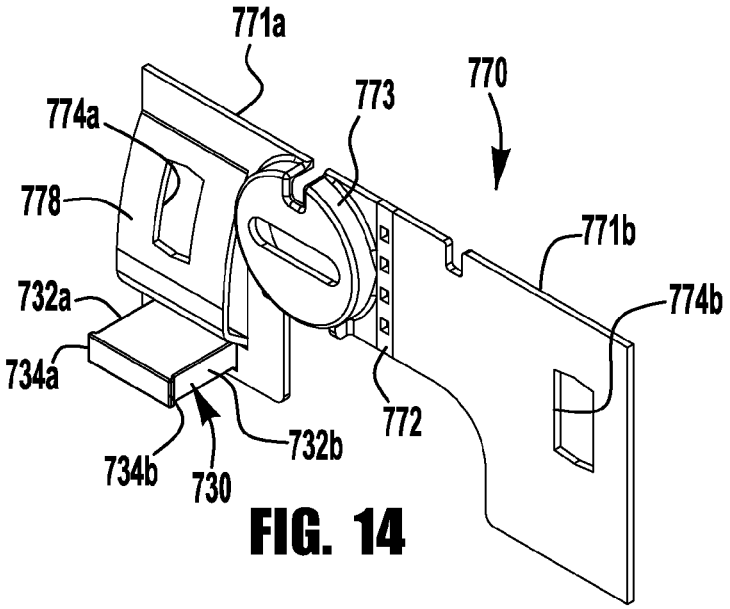
FIG. 14 is a front perspective view of a foldable key retainer for assembly with a hasp-bearing display card, according to an exemplary embodiment.
Figure 16:
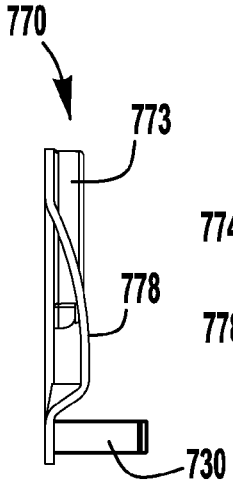
FIG. 16 is a side view of the key retainer of FIG. 14.
Figure 15:
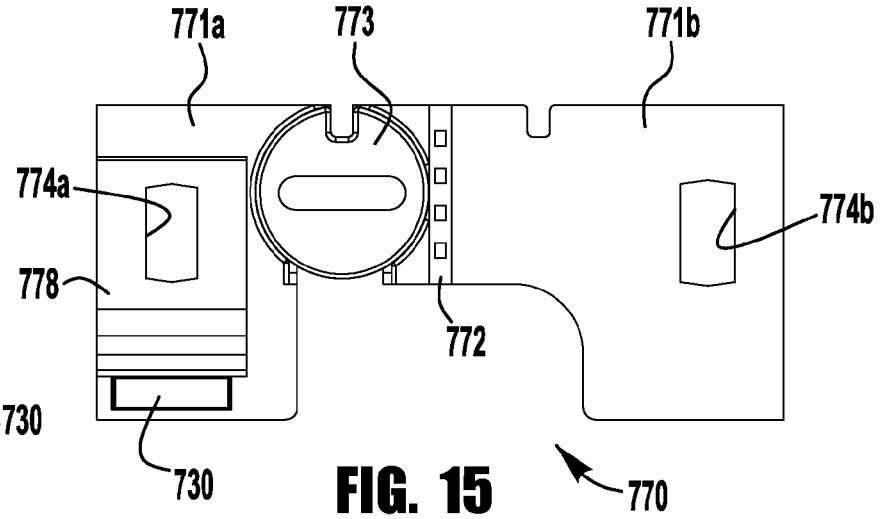
FIG. 15 is a front view of the key retainer of FIG. 14.
Figure 17:
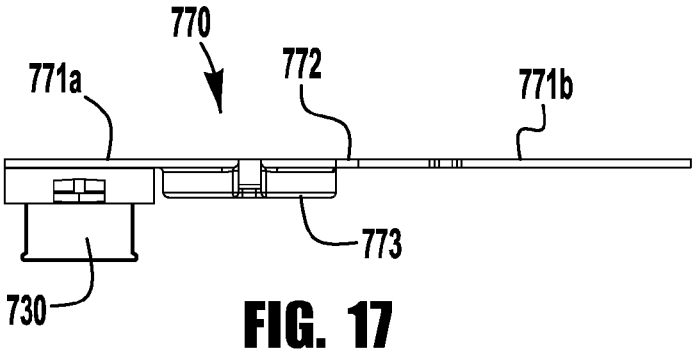
FIG. 17 is a top view of the key retainer of FIG. 14.

Besides hasps, other types of shackle retaining features may be utilized to secure a padlock to a display package and to provide a key retainer for securely retaining a key when the padlock is assembled with the display package. For example, a display package may be provided with a post or hook around which a padlock shackle may be secured, such that access to a cavity defined by the post or hook is blocked when the padlock shackle is secured around the post or hook. FIG. 12 illustrates an exemplary display package 500 including a post 520 extending from a front side of a base member 515. The post 520 may be integral with the base member 515 or assembled with the base member 515 (e.g., provided as a flanged insert, as described above). The post 520 includes side walls 522*a*, 522*b* having cutouts 523*a*, 523*b* defining a shackle receiving recess 525. The side walls 522*a*, 522*b* and front wall 528 define a cavity 521 and extend to an open upper end 524 of the post 520 to receive one or more keys K. A bottom wall 526 of the key retainer portion retains at least the key head h within the cavity 521. As shown, the bottom wall 526 may be provided with a slot 527 sized to receive the key blade b therethrough while retaining the key head h in the cavity 521. When a shackle s of a padlock P is received into the shackle recess 525, the shackle s blocks withdrawal of the key K from the key cavity 521 through the upper end 524 of the post 520. The exemplary post side walls 522*a*, 522*b* are shaped to engage inner surfaces of the shackle legs to limit side-to-side swinging movement of the padlock, and include laterally outward extending barbs or hooks 530*a*, 530*b* that engage front facing surfaces of the shackle legs to limit outward swinging movement of the padlock and prevent removal of the locked padlock P from the display package 500. The hooks 530*a*, 530*b* may be flexible enough to allow a padlock shackle to be pushed past the hooks to snap into a shackle retaining condition.

Figure 13:
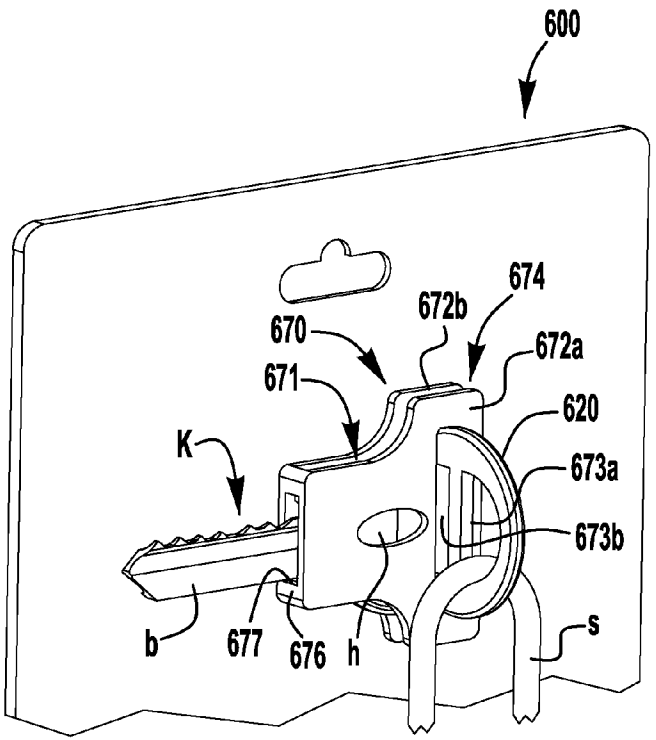
FIG. 13 is a partial perspective view of a display package with a key retainer secured on the hasp by a padlock shackle, according to an exemplary embodiment.

According to another aspect of the present application, a display package may be provided with a key retainer that is assembled with a shackle retaining member, such that when the padlock is secured to the display package, the padlock prevents disassembly of the key retainer from the shackle retaining member, with removal of the key from the key retainer being prevented when the key retainer is assembled with the shackle retaining member. FIG. 13 illustrates a partial view of an exemplary embodiment of a display package 600 including a hasp 620 extending from a front side of a base member 615 (e.g., integral or assembled with the base member, as described above), and a key retainer 670 having front and rear walls 672*a*, 672*b* defining a cavity 671 therebetween with an open end 674 for receiving a key K. The front and rear walls 672*a*, 672*b* are joined by an end wall 676 defining a slot 677 for receiving the key blade b therethrough, and sized to retain the key head h in the cavity 671. The front and rear walls 672*a*, 672*b* include hasp apertures 673*a*, 673*b* for receiving the hasp 620. When a padlock shackle s is inserted through the shackle passage or slot 625, the shackle s secures the key retainer 670 on the hasp and blocks withdrawal of the key K from the open end 674 of the key retainer. To access the key and unlock the lock (e.g., post-purchase), a user may cut a portion of the key retainer 670 (e.g., along the end wall 676) to extract the key, for example, using a knife, scissors, or other such household tool. The portion to be cut may be thinner or perforated to facilitate cutting.

In another embodiment, a separate key retainer for assembly with a shackle retaining member may be operable or moveable between a closed position enclosing at least a portion of the key (e.g., the key head) within a cavity, and an open position permitting withdrawal of the key (or key portion) from the cavity. When the key retainer is assembled with the shackle retaining member and the padlock is secured to the display package (e.g., by engaging the locked shackle with the shackle retaining member), the key retainer is secured to the shackle retaining member in the closed position. FIGS. 14-17 illustrate an exemplary key retainer 770 including first and second side portions 771*a*, 771*b* joined by a hinge portion 772 (e.g., a living hinge, perforated line, or line of thinner material). The first and second side portions 771*a*, 771*b* are foldable along the hinge portion 772 to enclose a key head in a recessed portion 773 of the first side portion 771*a*. As shown, the recessed portion 773 and an aligned portion of the second side portion 771*b* may be notched to accommodate a key ring. The side portions 771*a*, 771*b* include first and second apertures 774*a*, 774*b* that align when folded to receive a hasp therethrough. As shown, the first aperture 774*a* may be disposed in a flexible raised contoured portion 778 of the first side portion 771*a*, for example, to limit prying opening movement of the first side portion 771*a*when assembled with the display card and padlock. Additionally, the first side portion 771*a* may include a padlock retaining projection 730 having side portions 732*a*, 732*b* that engage inner surfaces of the shackle legs to limit side-to-side swinging movement of the padlock, and laterally outward extending barbs or hooks 734*a*, 734*b* that engage front facing surfaces of the shackle legs to limit outward swinging movement of the padlock. The hooks 734*a*, 734*b* may be flexible enough to allow a padlock shackle to be pushed past the hooks to snap into a shackle retaining condition.

In an exemplary process of packaging a padlock and key with an exemplary display package using the key retainer of FIGS. 14-17, the padlock is opened using the key, and the hasp is inserted through a hole in the display card from the rear, such that a flange portion of the hasp abuts the rear surface of the display card. (In other embodiments, the hasp may be integral to the display card.) The key is positioned on the key retainer with the key head in the recessed portion and the key ring in the notch. The first and second side portions of the key retainer are folded toward each other along the hinge portion, and held together in the closed position. The closed key retainer is placed over the hasp, with the hasp extending through the aligned apertures. The padlock shackle is threaded through the hasp slot, and is locked with the lock body. The shackle is pushed or snapped past the laterally extending hooks of the padlock retaining projection, to limit side-to-side and outward swinging movement of the padlock on the display card. To access the key and unlock the lock (e.g., post-purchase), a user may cut a portion of the key retainer (e.g., along the hinge) to extract the key, for example, using a knife, scissors, or other such household tool.

Still other features may be implemented with the display packages of the present application, at least some of which are described in the above incorporated U.S. Pat. Nos. 7,516,843; 7,708,140; 7,743,917; and 7,905,351. For example, a display package with an attached item may be configured to be displayed either by placement on a shelf or platform or by hanging from a rack or hook. Where the attached item is a free standing item (such as, for example, a padlock with a flat bottom surface), the display card may be sized such that a bottom surface of the item extends below the bottom of the card, such that the bottom surface may be directly supported by the shelf or platform. The display card may also include a cut-out portion that aligns with a portion of the attached item (for example, the lock body of a padlock) to allow the attached item to extend beyond the back side of the display card. This may allow for improved visibility and access to the rear facing surfaces of the attached item. Further, in one embodiment, the display package may be configured such that the display card is maintained in an angled (non-parallel) vertical orientation with respect to the item, for example, to aid in visibility of indicia or other markings on the front side of the display card when the display package and item are placed on a shelf below eye level. To hang the display package from a rack or hook (not shown), the display card may further define a punch hole or other such opening. The hole may be positioned on the card to align with the item to be attached to the display package, which may be offset from the center of the card, such that the display package with attached item will hang in a straight (non-crooked) orientation.

In other embodiments, a display package may be configured to retain and display multiple items, such as, for example, multiple padlocks. While many different configurations may be used to retain multiple items, in one embodiment, a display package may be provided with multiple hasps, wherein each hasp is configured to retain one item.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

I claim:

1. In combination, a padlock, a key for unlocking the padlock, and a padlock display package, the padlock having a shackle lockable with a lock body, the padlock display package comprising:

a base member having a front side and a back side; and a key retainer extending from the front side of the base member and including first and second side walls extending to an open upper end to define a cavity receiving the key therebetween, wherein the locked shackle of the padlock extends through a shackle passage in the key retainer cavity to secure the padlock to the display package;

wherein a portion of the padlock shackle in the shackle passage blocks removal of the key from the open upper end of the key retainer.

2. The combination of claim 1, wherein the first and second side walls form a hasp defining at least a portion of the shackle passage.

3. The combination of claim 2, wherein the hasp includes an upper portion that may be cut to remove the shackle from the hasp, thereby permitting withdrawal of the key from the key retainer cavity.

4. The combination of claim 1, wherein the key comprises a head portion and a blade portion, wherein the key retainer cavity is sized to enclose the head portion of the key.

5. The combination of claim 4, wherein the key retainer includes a slot sized to receive the key blade portion therethrough, such that the key blade extends outward of the key retainer.

6. The combination of claim 1, wherein the display package comprises an insert assembled through an opening in the base member, with a portion of the insert extending from the front side of the base member to define the key retainer.

7. The combination of claim 6 wherein the insert comprises an outer flange that abuts the rear side of the base member.

8. The combination of claim 6, wherein the portion of the insert extending from the front side of the base member includes a padlock retaining feature positioned to limit at least one of side-to-side swinging movement and outward swinging movement of the padlock.

9. The combination of claim 1, wherein the first and second side walls include first and second apertures defining first and second ends of the shackle passage, such that the portion of the padlock shackle blocking removal of the key from the open upper end of the key retainer extends between the first and second apertures.

10. In combination, a padlock, a key for unlocking the padlock, and a padlock display package, the padlock having a shackle lockable with a lock body, the padlock display package comprising:

a base member having a front side and a back side; and a hasp extending from the front side of the base member and including first and second side walls extending to an open upper end to define a cavity receiving the key therebetween, the first and second side walls including first and second apertures receiving the locked shackle of the padlock therethrough to secure the padlock to the display package, wherein a portion of the padlock shackle disposed between the first and second apertures blocks removal of the key from the open upper end of the key retainer.

11. The combination of claim 10, wherein the key comprises a head portion and a blade portion, wherein the cavity is sized to enclose the head portion of the key.

12. The combination of claim 11, wherein the hasp includes a slot sized to receive the key blade portion therethrough, such that the key blade extends outward of the hasp.

13. The combination of claim 10, wherein the display package comprises an insert assembled through an opening in the base member, with a portion of the insert extending from the front side of the base member to define the hasp.

14. The combination of claim 13 wherein the insert comprises an outer flange that abuts the rear side of the base member.

15. The combination of claim 13, wherein the portion of the insert extending from the front side of the base member includes a padlock retaining feature positioned to limit at least one of side-to-side swinging movement and outward swinging movement of the padlock.

16. In combination, a padlock, a key for unlocking the padlock, and a padlock display package, the padlock having a shackle lockable with a lock body, the padlock display package comprising:

a base member having a front side and a back side;

a hasp extending from the front side of the base member, the hasp including a shackle passage receiving the locked shackle therethrough; and a key retainer including first and second side walls joined by an end wall and retaining at least a portion of the key therebetween, the first and second side walls including aligned first and second apertures receiving the hasp therethrough;

wherein the key retainer is installed between the base member and the padlock shackle, such that the padlock shackle blocks removal of the key retainer from the hasp.

17. The combination of claim 16, wherein the end wall of the key retainer comprises a slot receiving a blade portion of the key therethrough.

18. The combination of claim 16, wherein the end wall of the key retainer comprises a flexible hinge portion.

* * * * *